US005645132A

United States Patent [19]

Åsberg

[11] Patent Number: 5,645,132

[45] Date of Patent: Jul. 8, 1997

[54] DRILL BIT HAVING SPRINGLESS CHECK VALVE AND METHOD OF BLOCKING BACKFLOW DURING DRILLING

[75] Inventor: Bengt Åsberg, Houston, Tex.

[73] Assignee: Sandvik AB, Sandviken, Sweden

[21] Appl. No.: 610,234

[22] Filed: Mar. 4, 1996

[51] Int. Cl.[6] ..... E21B 10/38

[52] U.S. Cl. ..... 175/318; 175/417

[58] Field of Search ..... 175/317, 318, 175/393, 417, 418, 419

[56] References Cited

U.S. PATENT DOCUMENTS

| | | | |
|---|---|---|---|
| 1,447,234 | 3/1923 | Carrol | 175/318 |
| 3,802,521 | 4/1974 | Oliver | 175/318 |

FOREIGN PATENT DOCUMENTS

| | | | |
|---|---|---|---|
| 853062 | 10/1970 | Canada . | |
| 316846 | 12/1971 | U.S.S.R. | 175/318 |
| 1001714 | 9/1983 | U.S.S.R. | 175/417 |

*Primary Examiner*—David J. Bagnell

*Attorney, Agent, or Firm*—Burns, Doane, Swecker & Mathis, L.L.P.

[57] ABSTRACT

A percussion drill bit includes a drill body having a fluid passage formed therein for conducting flushing fluid to a front drilling face of the drill bit. The fluid passage includes a main portion extending from a rear end of the bit and terminating short of the drilling face, and a plurality of branch lines extending from a front end of the main portion to the drilling face. Front and rear axially spaced seats are disposed in the main portion of the fluid passage. A check valve in the form of a ball is freely movable within the main portion of the fluid passage between contact with the front and rear seats. When the drill bit is oriented upwardly and no flushing fluid is supplied, the ball gravitates rearwardly into sealing contact with the rear seat so that no fluid can flow rearwardly past the rear seat. When flushing fluid is conducted, the flushing fluid pushes the ball forwardly, into non-sealing contact with the front seat and travels past the ball into the branch lines. During downwards drilling, if the density of the ball is less than that of backflowing fluid, the ball will float upwardly upon the back-flowing fluid and into sealing contact with the rear seat.

13 Claims, 2 Drawing Sheets

DRILL BIT HAVING SPRINGLESS CHECK VALVE AND METHOD OF BLOCKING BACKFLOW DURING DRILLING

BACKGROUND AND OBJECTS OF THE INVENTION

The present invention relates to percussive drilling equipment in which a hammer piston is impacted against a drill bit under the urging of a flow of flushing fluid such as air or water, and wherein flushing fluid is delivered to the front of the drill bit to cool and clean the cutting surface and flush cuttings from the bore.

In percussion drills, a drill bit mounted at the front end of a drill string is rotated and longitudinally impacted in order to cut through hard earth formations such as rock. The longitudinal impacts are transmitted from a reciprocable hammer piston driven by compressed fluid such as water or air which is supplied through a supply passage and applied alternately to front and rear ends of the piston to produce reciprocation of the piston. Surplus fluid, i.e., fluid over and above that needed to reciprocate the piston, flows forwardly to the front end of the drill bit in order to cool and clean the cutting elements. This fluid is termed flushing fluid because it also entrains the cuttings and flushes them from the bore hole through a passage spaced radially from the fluid supply passage.

During periods when no flushing fluid is being supplied to the drill bit, it is desirable to prevent a backflow of subterranean liquid through the fluid supply passage which could result in cuttings and other debris fouling, damaging the tool. For example, smaller cuttings could work their way to a position between the piston and outer casing, causing accelerated abrasive wear. The risk of liquid backflow typically exists mainly during upwards drilling, i.e., when the drill bit is advancing in an upwards direction, since gravity tends to promote such a backflow. Upwards drilling is performed, among other reasons, to interconnect vertically spaced mine shafts.

The backflow problem can also occur during downwards drilling, when the upward pressure of fluid disposed in the bore hole, such as subterranean fluid (e.g., a water and sand mixture) or accumulated flushing fluid (e.g. water, drilling mud etc.), is great enough to produce a backflow of the fluid past the drill bit.

Accordingly, it has been the practice to provide the fluid supply passage with a spring-biased check valve to prevent a backflow of subterranean liquid. In FIG. 4, for example, a conventional drill bit 2 includes a fluid supply passage 4 for conducting flushing fluid. The fluid supply passage includes a main portion 5, and a plurality of branch lines 6 extending to the front end of the drill bit from a front end of the main portion 5. A check valve disposed in the main portion 5 includes a ball 8 and a spring 10 yieldably biasing the ball towards a seat 12 to prevent a backflow of fluid from the drilling face. During a drilling operation, flushing fluid forces the ball 8 off the seat by compressing the spring 10 as shown in FIG. 4. A drawback to that check valve is that the ball remains directly in the path of fluid flow, causing the size of that path to be diminished. The cross-sectional size of the main portion 5 has to be made large enough so that the space between the ball 8 and a wall 14 of the passage can conduct the requisite amount of flushing fluid. However, the more material of the drill bit which is removed, for that purpose, the more the drill bit is weakened.

Also, the pressure of the fluid will tend to fluctuate, whereby the amount by which the spring is compressed will vary. That is, the spring will flex in response to the pressure fluctuations, and such flexing produces metal fatigue and possible spring breakage.

In Canadian Patent No. 853,062 there is disclosed a check valve in the shape of a flat disk having a central through-hole formed therein. The disc is mounted for free vertical movement on a guide pin which extends axially within the fluid passage, the guide pin passing through the through-hole. It is intended that the disk be positioned against a front seat during downwards drilling, to enable flushing fluid to travel past the disk en route to the front drilling face. In the event that liquid from the drilling face backs up into the fluid passage during a cessation of the flow of flushing fluid, it is intended that the disk float upwardly upon that liquid and into sealing contact with a rear seat to block further backflowing of the liquid. However, a potential problem is that debris such as cuttings may become lodged in the through-hole of the disk and thus opposes movement of the disk. In that event, it may be possible for the liquid and entrained particles to rise high enough to reach and abrade the percussion elements. Moreover, the presence of the guide pin in the fluid passage presents an obstacle to the downward flow of flushing fluid. Also, it becomes necessary to create a fluid seal between the through-hole and guide pin to prevent well fluid from flowing upwardly past the disk when the disk is in its upward sealing position. In addition, it is necessary to ensure that the guide pin remains in an axial orientation despite the forces imposed thereagainst, e.g., by the flow of flushing fluid; otherwise, the disk cannot create a proper seal. Hence, the overall structure of the check valve becomes more complicated, expensive, and subject to wear.

Therefore, it would be desirable to provide a check valve for a percussion drill which does not appreciably diminish the size of the fluid passage and does not involve a risk of spring breakage.

SUMMARY OF THE INVENTION

The present invention relates to a percussive drill bit comprising a body having a front drilling face. A fluid passage extends from a rear end of the body to the drilling face to conduct flushing fluid to the drilling face. A check valve is provided for closing the fluid passage. The fluid passage includes a main portion extending from the rear end of the body and terminating short of the drilling face, and a plurality of branch lines extending from a forward end of the main portion to the drilling face. The body includes a non-sealing front seat and a sealing rear seat spaced apart in a front to rear direction along the main portion. The check valve comprises a plug, preferably in the form of a ball, freely movable in the main portion between the front and rear seats. The plug is free of through-holes. The front seat is situated between the rear ends of the branch lines for being non-sealingly contacted by the plug when the plug is displaced thereagainst by flushing fluid flowing past the plug and into the branch lines. The rear seat is arranged in the main portion so that the plug can gravitate into sealing contact with the rear seat in the absence of a flow of flushing fluid through the fluid passage, when the drill bit is directed upwardly.

The plug can be provided with less density than any subterranean fluid being encountered, and less density than the flushing fluid being used. Consequently, during downwards drilling the plug can float upwardly on a backflow of fluid from the bore hole, and thus will engage the rear seat to produce a fluid seal therewith. For example, the density of the plug could be made less than the density of water, or less than the density of drilling mud.

The rear end of each branch line preferably extends rearwardly past the plug when the plug is in contact with the front valve seat, to minimize any obstruction to fluid flow.

The plug can be formed of any suitable material, such as plastic, elastomer, and metal.

The present invention also relates to a percussive drilling apparatus which includes the above described drill bit, and to methods of upward and downward drilling using the drill bit.

BRIEF DESCRIPTION OF THE DRAWINGS

The objects and advantages of the invention will become apparent from the following detailed description of a preferred embodiment thereof in connection with the accompanying drawing in which like numerals designate like elements and in which.

DETAILED DESCRIPTION OF A PREFERRED EMBODIMENT OF THE INVENTION

Figure 1:
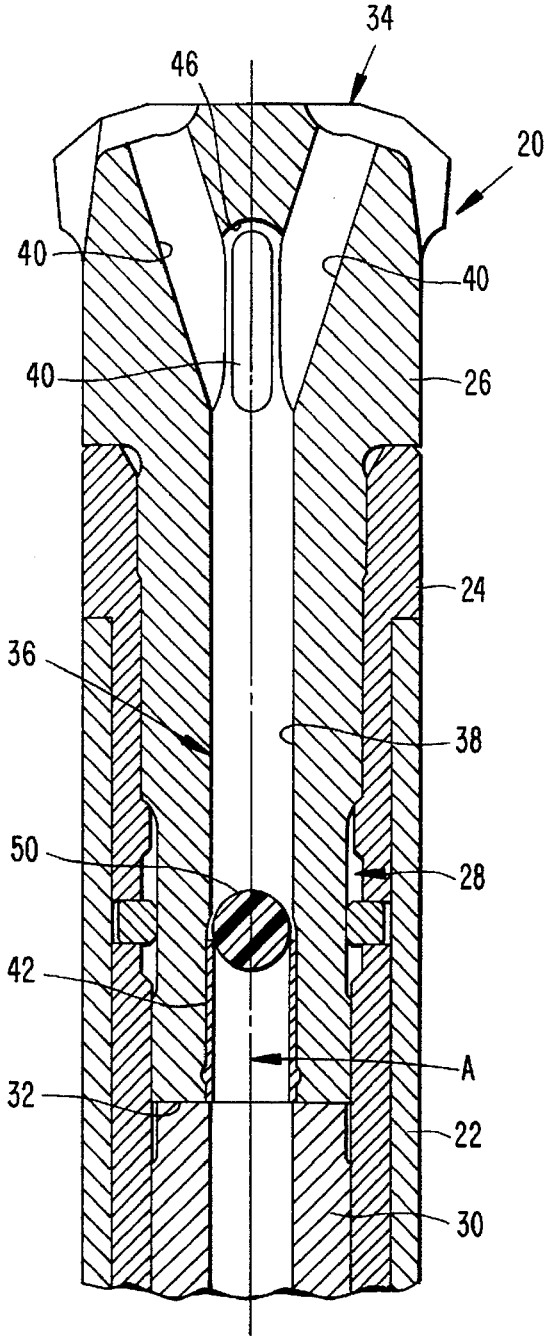
FIG. 1 is a longitudinal sectional view taken through the front end of a percussive drilling apparatus according to the invention, when the drilling apparatus is directed upwardly, and no flushing fluid is conducted through the drill bit.
Figure 2:
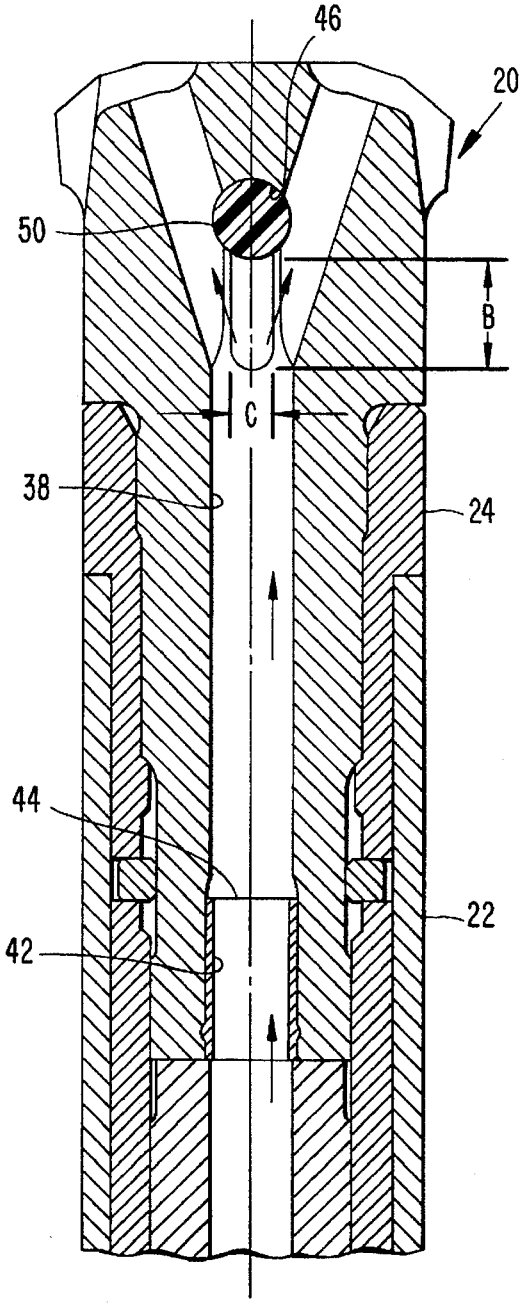
FIG. 2 is a view similar to FIG. 1 when flushing fluid is directed through the drill bit.

The front end of a percussive drilling apparatus 20 depicted in FIGS. 1 and 2 comprises a piston case 22, a driver sub 24 mounted within the piston case 22, and a drill bit 26 connected within the driver sub by a spline connection 28 to enable the drill bit 26 to be rotatably driven by the driver sub while being longitudinally movable relative thereto along an axis A. A piston 30 is mounted for longitudinal reciprocation within the piston case 22 and is reciprocated by fluid such as liquid (e.g., water) or air in a conventional manner. The piston thus impacts against a rear end 32 of the drill bit to impart percussive shocks thereto to aid in penetrating earth and rock formations.

The drill bit 26 includes a steel body having a front drilling face 34 carrying cutting elements (not shown), and a fluid passage 36 for conducting fluid, such as surplus fluid from the piston 30. That fluid (flushing fluid) travels through a center of the piston 30, then through a main portion 38 of the fluid passage 36, and finally through a plurality of branch lines 40 of the fluid passage 36. The main portion 38 terminates short of the front drilling face 34 of the drill bit body, and the branch lines extend to that front drilling face 34 from a front end of the main portion 38. The branch lines extend obliquely relative to the axis A, and have a smaller cross section than the main portion 38.

Fixed in a slightly widened section of the main portion 38 of the fluid passage 36 is a hollow tube 42. A front end of that tube 42 forms a rear seat 44 surrounding a cross section of the main portion 38.

The drill bit body includes a surface 46 situated forwardly of the rear seat 44 along the axis A and forming a front seat.

Disposed in the main portion 38 is a check valve which comprises a plug 50 in the form of an element at least the outer surface of which is solid (i.e., the element could include an enclosed internal hollow space. In other words, the plug is free of through-holes. The wall of the main portion of the fluid passage thus defines the sole means of guiding the plug during its movement within the main portion 38. The plug is preferably in the form of a ball. The front seat 46 is preferably of part-spherical shape, having a diameter corresponding to that of the ball.

The ball 50 is disposed in the main portion 38 and is freely longitudinally movable therein, the ball being free of mechanical opposition such as a spring bias. The ball is of a larger diameter than the rear seat 44 so that when in contact with the rear seat 44, the ball blocks a backflow of subterranean liquid from the front end of the drill bit. Thus, the rear seat 4 constitutes a sealing seat.

The diameter of the ball 50 is such that when the ball 50 is in contact with the front seat 46, a portion of the rear end of each branch line 40 extends rearwardly past the ball 50 by a distance B that is greater than the ball diameter. Thus, the front seat 46 is a non-sealing, ball-supporting seat.

The rear end of each branch line 40 has a smaller cross section than the ball 50. Preferably that is achieved by making a width C of that rear end shorter than the ball diameter. Consequently, the ball 50 cannot enter a branch line.

The ball is formed of any suitable material such as plastic, elastomer (rubber or soft plastic), metal, etc., but preferably is formed of a soft, light plastic or elastomeric material in order to minimize wearing of the valve seats. Also, as will be explained below, it is desirable that, in a drill bit intended for downwards drilling, the ball should have less density than fluids expected to be encountered as potential backflow fluids, e.g., subterranean fluid and flushing fluid.

In practice, when the drill bit 20 is performing upwards drilling, and no flushing fluid is being conducted through the fluid passage 36, the ball 50 gravitates into contact with the rear seat 44 as shown in FIG. 1. Accordingly, any backflow of subterranean liquid will be halted by the ball 50 and thus will be prevented from fouling the equipment. When flushing fluid is conducted through the fluid passage 36 of the upwardly directed drill bit, the flushing fluid will force the ball upwardly until the ball contacts the front seat 46, as shown in FIG. 2. In that position, the ball is disposed essentially out of the path of flow of the flushing fluid so that such flow is essentially unobstructed by the ball.

Figure 3:
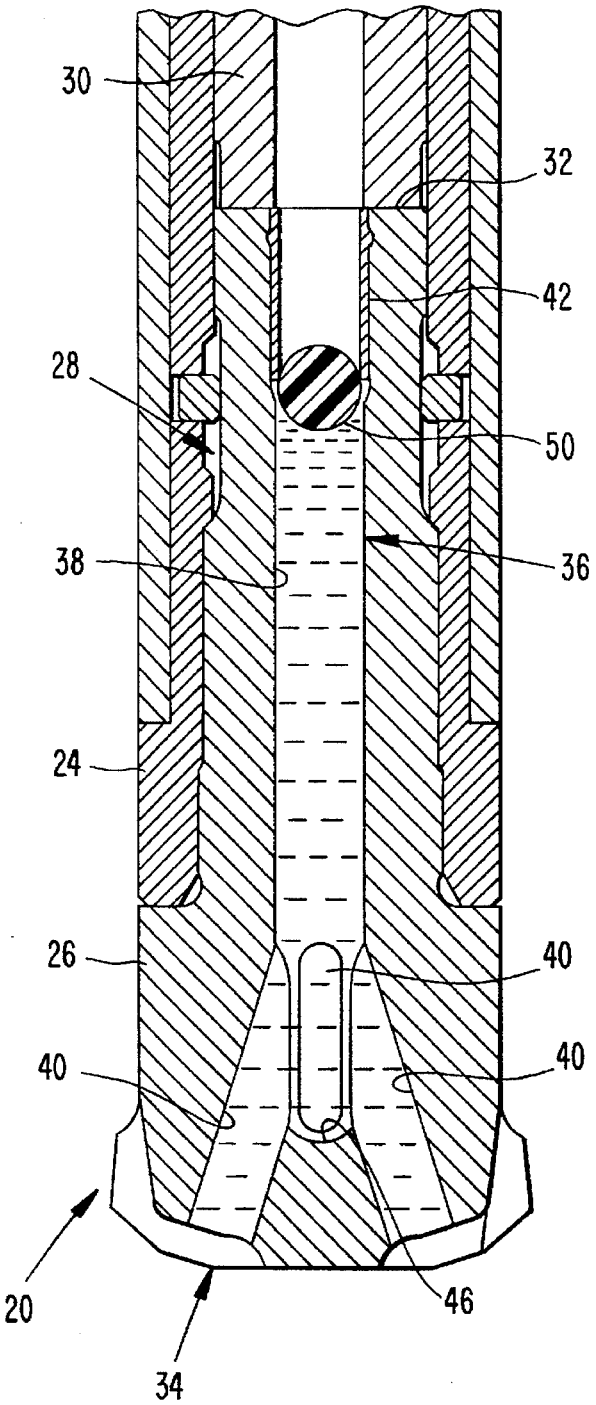
FIG. 3 is a view similar to FIG. 1 during downwards drilling.
Figure 4:
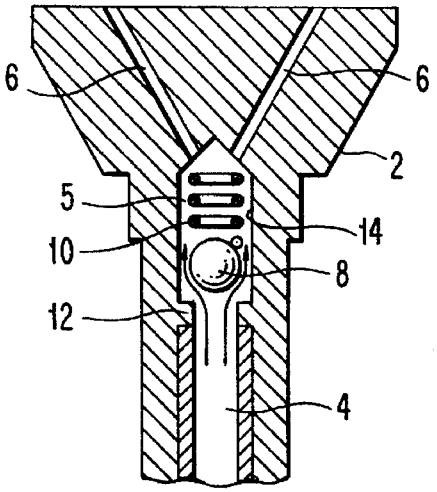
FIG. 4 (PRIOR ART)
FIG. 4 is a longitudinal sectional view taken through a drill bit having a conventional check valve.

Whenever the drill is engaged in downwards drilling, the ball 50 will be situated in contact with the front seat 46 when (a) flushing fluid is being conducted, or (b) when the flow of flushing fluid stops and there exists no backflow of fluid from the drilling face. However, in the event that such a backflow does occur, due to a sufficient back pressure of subterranean fluid and/or accumulated flushing fluid, the fact that the density of the ball is less than that of such fluids, means that the ball will float on the back-flowing fluid and thus will be lifted into sealing contact with the rear seat 44, as shown in FIG. 3.

It will be appreciated that the present invention ensures that the flow of flushing fluid encounters minimal obstruction due to the check valve, and thus the cross section of the main portion 38 can closely approximate the diameter of the ball 50. Hence, the removal of additional material from the drill bit (and the accompanying weakening of the drill bit) to form an enlarged fluid-conducting space is avoided. Also, the need for a valve-biasing spring is avoided by the present invention, whereby problems associated with fatigue-induced spring breakage are also avoided.

Furthermore, the plug is not guided on elements passing through a through-hole of the plug, which is susceptible to becoming clogged with debris that could hamper the plug movement, or which requires further measures to become sealed against fluid flow.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A percussive drill bit comprising a body having a front drilling face, a fluid passage extending from a rear end of the body to the drilling face to conduct flushing fluid to the drilling face, and a check valve for closing the fluid passage; the fluid passage including a main portion extending from the rear end of the body and terminating short of the drilling face, and a plurality of branch lines extending from a forward end of the main portion to the drilling face; the body including a non-sealing front seat and a sealing rear seat spaced apart in a front-to-rear direction along the main portion; the check valve comprising a plug freely movable in the main portion between contact with the front and rear seats; the plug being free of through-holes; the front seat being situated between the rear ends of the branch lines for being non-sealingly contacted by the plug when the plug is urged thereagainst by flushing fluid flowing past the plug and into the branch lines; the rear seat being arranged in the main portion to enable the plug to gravitate into sealing contact with the rear seat in the absence of a flow of flushing fluid through the fluid passage, when the drill bit is directed upwardly.

2. The drill bit according to claim 1, wherein the rear end of each branch line extends rearwardly past the plug when the plug is in contact with the front seat.

3. The drill bit according to claim 2, wherein the plug is a ball, the rear end of each branch line extending rearwardly past the ball, when the ball is in contact with the front seat, by a distance greater than a ball diameter.

4. The drill bit according to claim 1, wherein the plug is formed of plastic.

5. The drill bit according to claim 1, wherein the plug is formed of an elastomer.

6. The drill bit according to claim 1, wherein the plug is formed of metal.

7. The drill bit according to claim 1, wherein the rear seat is formed by a hollow tubular insert disposed within the main portion.

8. The drill bit according to claim 1, wherein the plug is a ball.

9. The drill bit according to claim 1, wherein the plus has a density less than a density of the flushing fluid and subterranean fluid so that the plug can float into contact with the rear seat on a backflow of fluid from the drilling face during downwards drilling.

10. A percussion drilling apparatus comprising a casing, a driver sub mounted at a front end of the casing for rotation therewith, a drill bit mounted in the driver sub for rotation therewith and axial movement relative thereto, and a hammer piston disposed behind the drill bit for delivering percussive impacts thereto; the drill bit comprising a body having a front drilling face, a fluid passage extending from a rear end of the body to the drilling face to conduct flushing fluid to the drilling face, and a check valve for closing the fluid passage; the fluid passage including a main portion extending from the rear end of the body and terminating short of the drilling face, and a plurality of branch lines extending from a forward end of the main portion to the drilling face; the body including a non-sealing front seat and a sealing rear seat spaced apart in a front-to-rear direction along the main portion; the check valve comprising a plug freely movable in the main portion between contact with the front and rear seats; the plug being free of through-holes; the front seat being situated between the rear ends of the branch lines for being non-sealingly contacted by the plug when the plug is urged thereagainst by flushing fluid flowing past the plug and into the branch lines; the rear valve seat being arranged in the main portion to enable the plug to gravitate into sealing contact with the rear seat in the absence of a flow of flushing fluid through the fluid passage, when the drill bit is directed upwardly.

11. The percussion drilling apparatus according to claim 10, wherein the plug has a density less than a density of the flushing fluid and subterranean fluid so that the plug can float into contact with the rear seat on a backflow of fluid from the drilling face during downwards drilling.

12. A method of blocking fluid backflow during downwards drilling comprising the steps of:

A) advancing downwardly through a subterranean formation a drill bit comprising a body having a front drilling face, a fluid passage extending from a rear end of the body to the drilling face to conduct flushing fluid to the drilling face, and a check valve for closing the fluid passage; the fluid passage including a main portion extending from the rear end of the body and terminating short of the drilling face, and a plurality of branch lines extending from a forward end of the main portion to the drilling face; the body including a non-sealing front seat and a sealing rear seat spaced apart in a front-to-rear direction along the main portion; the check valve comprising a plug freely movable in the main portion between contact with the front and rear seats; the plug being free of throughholes; the front seat being situated between the rear ends of the branch lines for being non-sealingly contacted by the plug when the plug gravitates downwardly thereagainst;

B) conducting flushing fluid downwardly through the fluid passage, past the plug contacting the front seat, through the branch lines, and to the drilling face, during step A; and C) causing the plug to float upwardly on backflowing fluid from the drilling face and into sealing contact with the rear seat, when step B is terminated.

13. A method of blocking fluid backflow during upwards drilling comprising the steps of:

A) advancing upwardly through a subterranean formation a drill body comprising a body having a front drilling face, a fluid passage extending from a rear end of the body to the drilling face to conduct flushing fluid to the drilling face, and a check valve for closing the fluid passage; the fluid passage including a main portion extending from the rear end of the body and terminating short of the drilling face, and a plurality of branch lines extending from a forward end of the main portion to the drilling face; the body including a non-sealing front seat and a sealing rear seat spaced apart in a front-to-rear direction along the main portion; the check valve comprising a plug freely movable in the main portion between contact with the front and rear seats; the plug being free of throughholes; the rear seat being sealingly contacted by the plug when the plug gravitates downwardly thereagainst, to create a fluid seal across the fluid passage; and B) conducting flushing fluid upwardly through the drill passage to force the plug off the rear seat and into non-sealing contact with the front seat, to enable flushing fluid to travel past the plug and into the branch lines for travel to the drilling face.

* * * * *